United States Patent [19]

Kessler et al.

[11] 4,347,823

[45] Sep. 7, 1982

[54] THROTTLE BODY INJECTION APPARATUS WITH DISTRIBUTION SKIRT

[75] Inventors: David R. Kessler, Churchville; Thomas J. Gutmann; Charles E. Finn, both of Rochester, all of N.Y.

[73] Assignee: General Motors Corporation, Detroit, Mich.

[21] Appl. No.: 237,291

[22] Filed: Feb. 24, 1981

[51] Int. Cl.[3] ..... F02M 39/00

[52] U.S. Cl. ..... 123/472; 123/478; 261/116; 261/DIG. 39; 261/DIG. 82

[58] Field of Search ..... 123/472, 478, 445; 261/116, DIG. 39, DIG. 82

[56] References Cited

U.S. PATENT DOCUMENTS

| | | | |
|---|---|---|---|
| 682,905 | 9/1901 | Bland, Jr. | 261/DIG. 39 |
| 3,761,065 | 9/1973 | Rich et al. | 261/116 |
| 4,149,496 | 4/1979 | Palma | 261/116 |
| 4,186,708 | 2/1980 | Bowler | 123/445 |
| 4,310,476 | 1/1982 | Nahra et al. | 261/116 |

*Primary Examiner*—P. S. Lall

*Attorney, Agent, or Firm*—Arthur N. Krein

[57] ABSTRACT

A hollow, truncated cone-shaped distribution skirt is positioned beneath a fuel injector discharging fuel into a throttle bore of a throttle body injection apparatus whereby to divide induction air flow into two flow paths so as to improve the distribution of the air-fuel mixture following through the throttle bore upstream of the pivotable throttle valve therein.

3 Claims, 3 Drawing Figures

THROTTLE BODY INJECTION APPARATUS WITH DISTRIBUTION SKIRT

FIELD OF THE INVENTION

This invention relates to charge-forming devices for spark ignition, internal combustion engines and, in particular, to a throttle body injection apparatus with distribution skirt for use on such an engine.

DESCRIPTION OF THE PRIOR ART

A throttle body injection apparatus of the type disclosed, for example, in U.S. Pat. No. 4,186,708 entitled Fuel Injection Apparatus with Wetting Action issued Feb. 5, 1980 to Lauren L. Bowler and as presently used on internal combustion engines of commercially available motor vehicles, includes a throttle body with at least one throttle bore therethrough and having a throttle valve operatively positioned in the throttle bore to control flow therethrough and an injector mechanism operatively connected to the throttle body. The injector mechanism includes at least one fuel injector that is positioned to discharge fuel into the associate throttle bore upstream of the throttle valve, the fuel injector being supplied with low pressure fuel for injecting the same in pulses in substantially a hollow cone spray pattern.

SUMMARY OF THE INVENTION

In order to improve the distribution of the air fuel mixture supplied in such a throttle body injection apparatus, there is now provided, in accordance with the subject invention, a distribution skirt insert positioned in the associate throttle bore in the throttle body beneath the associate fuel injector, which is operative to divide the air flow into the throttle bore into two flow paths, one flow path being external of the distribution skirt and the other flow path extending through the distribution skirt.

It is therefore a primary object of this invention to provide an improved throttle body injection apparatus having a hollow distribution skirt insert positioned between a fuel injector and its associate throttle bore in the throttle body of the unit whereby to divide the air flowing into the throttle bore into two flow paths for improved distribution of the air fuel mixture flowing through the throttle bore.

Another object of this invention is to provide an improved throttle body injection apparatus for supplying an induction charge to a spark ignition, internal combustion engine, wherein a hollow, truncated cone-shaped distribution skirt is positioned between a fuel injector and its associated throttle bore in a throttle body of the apparatus whereby to improve the distribution of the air-fuel mixture flowing through the throttle bore upstream of the throttle valve therein.

Still another object of the present invention is to provide an apparatus of the above type which includes features of construction, operation and arrangement, rendering it easy and inexpensive to manufacture, reliable in operation, readily serviced, and in other respects suitable for use on production motor vehicles.

For a better understanding of the invention, as well as other objects and further features thereof, reference is had to the following detailed description of the invention to be read in connection with the accompanying drawings, wherein.

DESCRIPTION OF A PREFERRED EMBODIMENT

Figure 1:
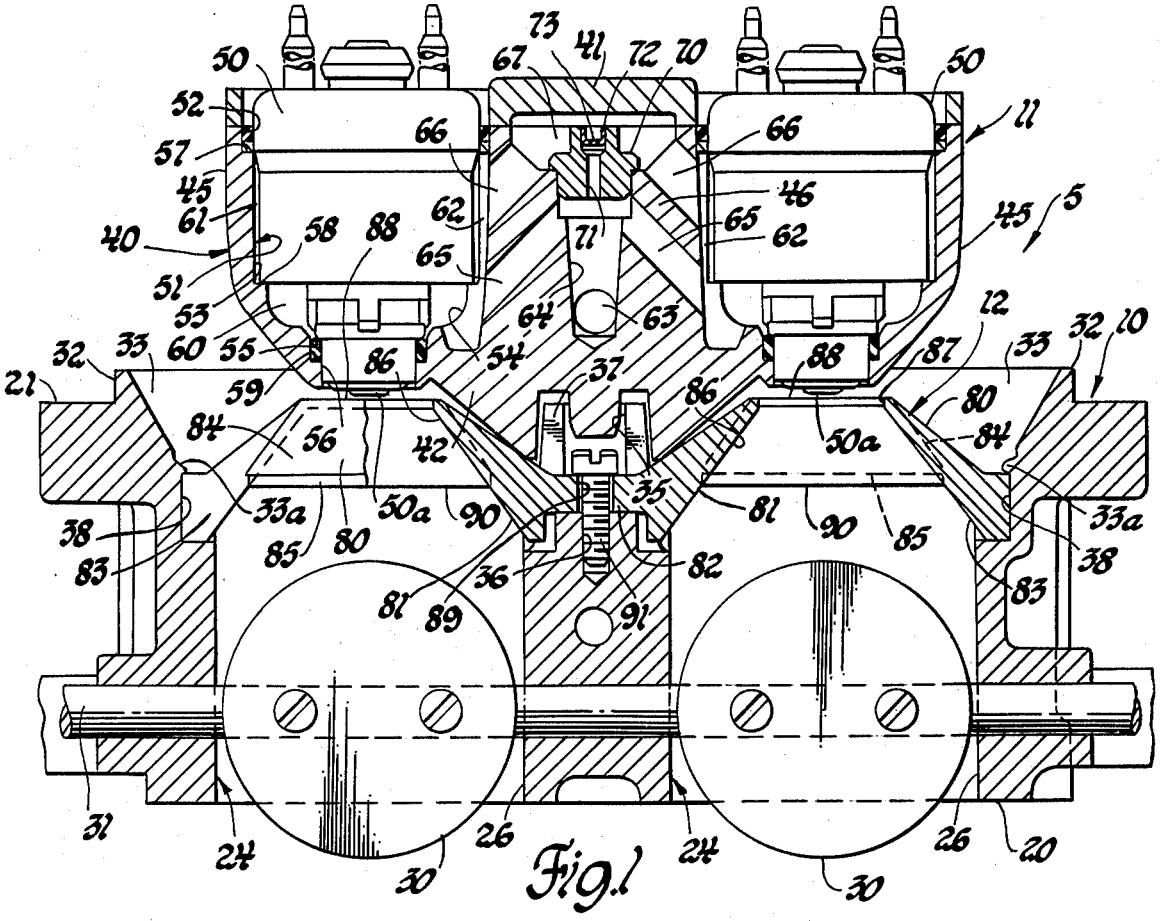
FIG. 1 is a longitudinal cross-sectional view of a preferred embodiment of a throttle body injection apparatus with distribution skirt in accordance with the invention, showing the fuel injectors, throttle shaft and throttle valves in elevation, with the throttle valves shown substantially fully open.

Referring now to the drawings, the throttle body injection apparatus, generally designated 5, in the embodiment illustrated, includes a throttle body 10 with an injector mechanism 11 operatively mounted thereon, and a distribution skirt insert 12, in accordance with the invention, suitably mounted to the throttle body 10 in a manner and for a purpose to be described in detail hereinafter.

The throttle body 10, in the construction shown, is of a suitable external configuration, as desired, and is provided with suitable base having a flat lower surface 20 (FIG. 1) for attachment to and over the inlet of an intake manifold, not shown, of an engine. Alternately, a heat insulating mounting plate, not shown, constructed of a fiber-board core with BUNANASBESTOS facing on both sides or equivalent materials, can be positioned between the throttle body 10 and the usual machine mounting pad on the top of the intake manifold, not shown, of the engine. This intake manifold may be a dual plane or a single plane intake manifold, as known in the art.

Figure 3:
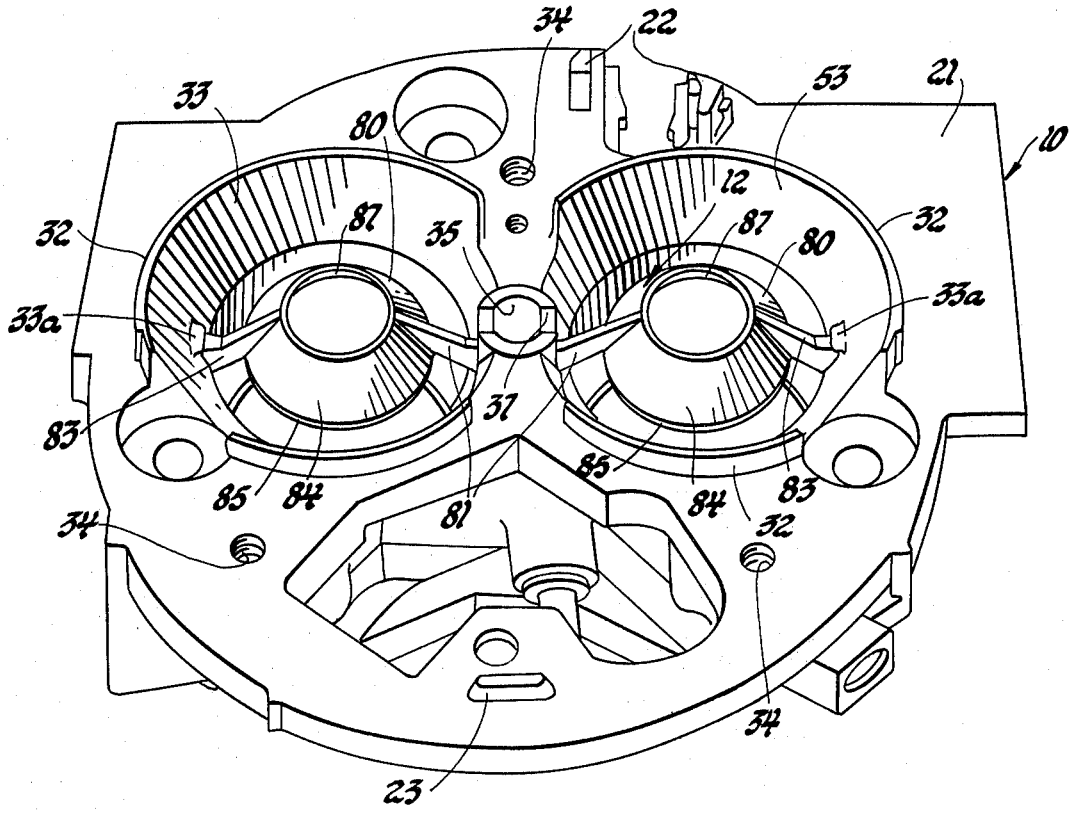

Throttle body 10 is also provided with an opposed upper surface 21 suitably spaced apart from surface 20. Preferably, as best seen in FIG. 3, the throttle body 10 is provided with suitable alignment bosses 22 and 23 that extend upward from the upper surface 21 thereof, whereby the lower rim of a conventional air cleaner, not shown, can be suitably mounted to the throttle body.

Figure 2:
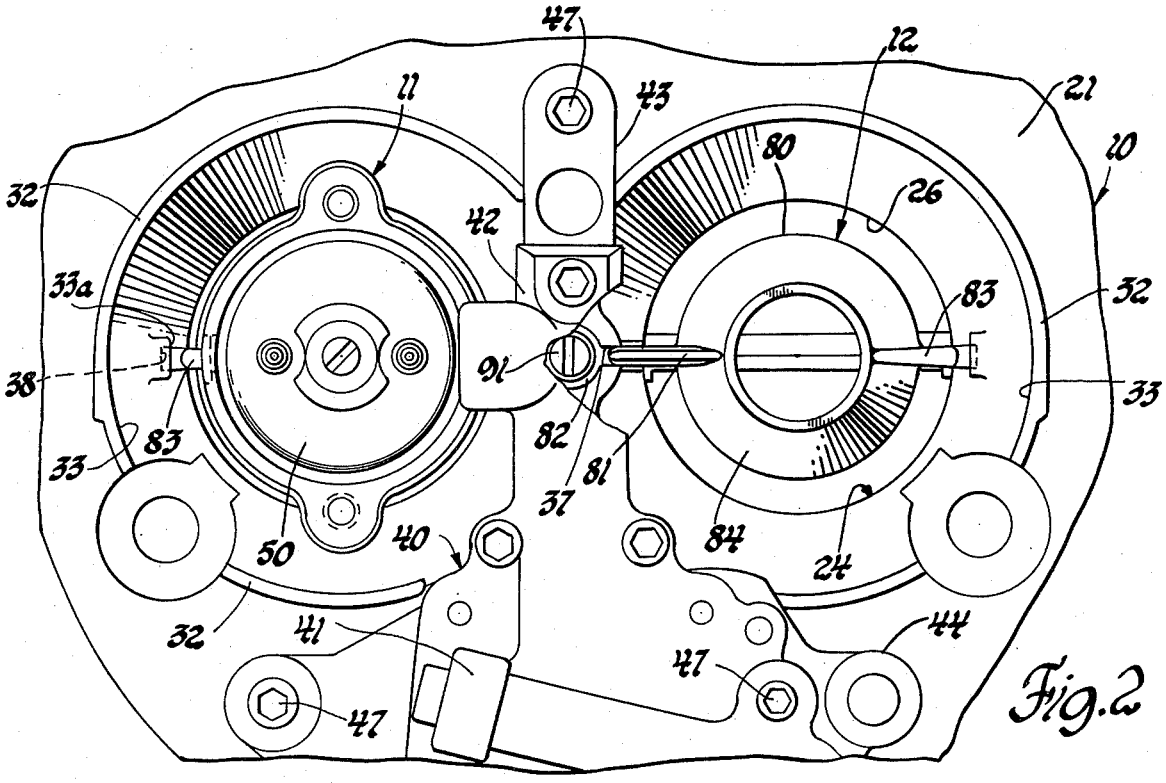
FIG. 2 is a top view of the apparatus of FIG. 1 with parts of the injector mechanism broken away to show details of the distribution skirt; and, FIG. 3 is a perspective view of the throttle body and distribution skirt only of the structure of FIGS. 1 and 2.

Although the throttle body 10 may be provided, for example, with only a single throttle bore extending therethrough, in the construction illustrated and as best seen in FIG. 1, it is provided with a pair of spaced apart throttle bores 24 extending therethrough from the upper surface 21 to the lower surface 20, see FIG. 2. In the embodiment illustrated, each throttle bore 24 is defined by cylindrical internal walls 25.

As best seen in FIG. 1, flow through each of the throttle bores 24 is controlled by a circular disc type throttle valve 30 suitably fixed to a throttle shaft 31 that intersects the wall 26 portion of each throttle bore and is pivotally journaled in the throttle body 10. The throttle valves 30 are thus suitably interconnected by the throttle shaft 31 whereby the operation of the throttle valves may be effected by a suitable throttle valve actuating mechanism, not shown. The throttle valve actuating mechanism is not shown or described since such a throttle valve actuating mechanism forms no part of the subject invention. For the same reason, other elements, such as air flow and throttle temperature sensors, which may be normally associated with the throttle body 10 as part of the control system for controlling movement of the valves and for the associated fuel injection system, are not illustrated or described since they are not deemed necessary for an understanding of the subject invention.

In addition, in order to guide the induction air flow into the throttle bores, the throttle body 10, in the embodiment illustrated, is provided with two non-continuous semi-circular air flow guides 32 that extend upward from the upper surface 21 a predetermined distance. Each such air flow guide 32 is positioned concentric with an associate throttle bore so that its internal inclined wall surface 33 merges with the associate internal bore wall 26. As shown, each inclined wall surface 33 is downwardly inclined at a suitable angle to the axis of the throttle bore to define a converging flow path, in terms of the direction of air flow.

The injector mechanism 11 includes a housing, which in the embodiment illustrated is a multi-piece housing, consisting of an injector body 40 and cover 41 suitably secured together as by means of screws 14.

In the embodiment shown and as best seen in FIGS. 1 and 2, the injector body 40 includes a base portion 42 and a base portion 43 extending at subsequently right angles to the base portion 42, a regulator portion 44 extending upward from base portion 42 and, a pair of spaced apart injector holder portions 45 interconnected by a central web 46, the latter being best seen in FIG. 1. Each base portion 42 and 43 is formed with a lower flat support surface, not shown, for abutment against the upper surface 21 of the throttle body, with suitable apertures being provided therethrough to receive mounting screws 47 (FIG. 2) threaded into suitable threaded apertures 34 provided for this purpose in the throttle body 10, as shown in FIG. 3.

As best seen in FIG. 1, the configuration of the injector body 40 is such that when it is mounted on the throttle body 10, each injector holder portion 45 is supported above an associate throttle bore 24. As illustrated, the lowermost end portion of each injector holder portion 45 is thus positioned a predetermined distance above the upper surface 21 of the throttle body 10. By thus positioning the injector holder portions 45 above the upper surface 21 of the throttle body, induction air can flow around the outer peripheral surface of the injector mechanism and into the throttle bores 24.

To provide for the injection of fuel into the air stream flowing through the throttle bores 24, two electromagnetic fuel injectors 50 are supported in suitable sockets 51 provided in the injector holder portions 45 of the injector body 40 whereby each injector is positioned to inject fuel into an associate throttle bore as shown in FIG. 1.

Although the fuel injectors 50 may be of any suitable type preferably capable of operation when supplied with fuel at a nominal low pressure, in the embodiments shown, they are preferably of the type disclosed in U.S. Pat. No. 4,218,021 entitled "Electromagnetic Fuel Injector" issued Aug. 19, 1980 to James D. Palma, the disclosure of which is incorporated herein by reference thereto. This type of electromagnetic fuel injector is adapted to be supplied with low pressure fuel and is adapted to inject the same in pulses in a substantially hollow conical spray pattern.

As best seen in FIG. 1, each socket 51 is provided by a through stepped bore in an injector holder portion 45 which is properly sized so as to accommodate the particular fuel injector 50 to be mounted therein. Thus in the construction illustrated each socket 51 is defined by an annular upper wall 52, an intermediate upper wall 53, a middle curved wall 54, a lower intermediate wall 55 and a lower wall 56. Walls 53, 54, 55 and 56 are of progressively reduced internal diameters relative to the internal diameter of upper wall 52. Walls 52 and 53 are interconnected by a flat shoulder 57. Walls 53 and 54 are interconnected by a flat shoulder 58. Walls 54 and 55 are interconnected by a flat shoulder 59. Each socket 51 as thus defined, forms with the outer peripheral surface of its associate fuel injector 50 a lower fuel supply chamber 60 located so as to be in fluid communication with the inlet ports, not shown, of the associate fuel injector 50 and an annular fuel drain chamber 61 located above the associate supply chamber 60 in flow communication therewith as by means of a suitable slot passage 62 formed so as to suitably interconnect these chambers, as best seen in FIG. 1.

As shown in FIG. 1, fuel is supplied to the fuel supply chambers 60 via a central supply passage 63 extending through the web 46 so as to intersect a vertical stepped passage 64 which in turn is in flow communication with a pair of downwardly inclined passages 65. In a similar manner the fuel drain chambers 61 are connected by inclined drain passages 66 in flow communication with a central, fuel return chamber 67 in the web 46.

Preferably as shown in FIG. 1, a suitable cylindrical fitting 70 is secured in the upper portion of passage 64 and is provided with a stepped bore 71 therethrough. A cup-shaped insert 72 with a vapor bleed orifice 73 of predetermined flow area therethrough is suitably positioned in bore 71 whereby these elements provide a flow passage for flow of fuel vapors from passage 64 to fuel return chamber 67.

The injector body 40 is provided with suitable fuel supply and drain conduits and connections, not shown, in a known manner, whereby it can be connected to a source of fuel at a predetermined low supply pressure for the supply of fuel to the fuel injectors 50 and to a fuel tank, not shown, whereby excess fuel can be returned to the source of fuel. A pressure regulator, not shown, is adapted to be located in the pressure regulator portion 44 whereby to control the pressure of fuel, in a manner similar to that disclosed in the above-identified U.S. Pat. No. 4,186,708. These last described elements have not been shown or described in detail herein since they do not form a part of the subject invention and are not deemed necessary for an understanding of the subject invention.

Each fuel injector 50 is positioned in its associated socket 51 with a shoulder thereof in abutment against a flat wall 58 so that the spray tip end **50*a* thereof is positioned co-axially with the associated throttle bore at a suitable predetermined distance above the upper surface 21 of the throttle body therebetween a predetermined distance upstream of the throttle valves. Each fuel injector 50** is thus positioned so as to discharge fuel in pulses in a substantially hollow conical spray pattern toward the associated bore wall upstream of the throttle valve therein.

The structure thus far described is substantially similar to the throttle body injection apparatus disclosed in the above-identified U.S. Pat. No. 4,186,708, the disclosure of which is incorporated herein by reference thereto.

Now in accordance with the subject invention, a distribution skirt insert 12 is suitably mounted on the throttle body 10 so as to be positioned beneath the injector holder portions 45 of the injector mechanism 11.

In the construction illustrated, the distribution skirt insert 12 for use with the throttle body shown, includes a pair of distribution skirts 80 each of which is of hollow, truncated, conical ring-like configuration, these distribution skirts being interconnected by a support strut 81 to a central mounting boss 82. Each distribution skirt 80 is also provided with a support strut 83 that extends radially outward diametrically opposite an associated support strut 81. Preferably the major portions of the support struts 81 and 83 that are exposed to air flow are of a suitable aerodynamic design, such as an elliptical shape when viewed in cross section, for improved air flow thereabout.

In the embodiment illustrated, each distribution skirt 80 is provided with an inclined outer wall 84 that terminates at its lower end in a vertical straight wall 85 and an inclined internal wall 86 which terminates at its upper end in a vertical straight internal wall 87. As best seen in FIG. 1, the upper and lower end surfaces 88 and 90, respectively, of each distribution skirt is flat.

Preferably and as best seen in FIG. 3, the outer and inner wall surfaces 84 and 86, respectfully, are substantially parallel to each other and are suitably inclined relative to the axis of the bore wall so as to be divergent relative to the direction of flow of induction air through the throttle bores. Also as shown, the maximum outside diameter of the outer surface 84 and therefore of the associated outer straight wall 85 is a suitable predetermined amount less than the inside diameter of the bore wall 25 so that when the distribution skirt is mounted within an associated throttle bore an annular flow path of predetermined flow area is formed therebetween.

The distribution skirt insert 12 is suitably fixed to the throttle body 10 so that each distribution skirt 80 is positioned substantially concentrically in the bore wall 25 beneath an associate fuel injector 50.

For this purpose and as best seen in FIG. 1, the support boss 82 is provided with a vertical bore 89 extending therethrough which is adapted to receive a screw 91 whereby the distribution skirt insert 12 can be secured to the throttle body 10.

In addition, the throttle body 10 is provided in the portion thereof between the throttle bores with a blind stepped bore that extends from the upper surface 21 so as to provide an internal upper wall 35 and a lower internally threaded wall 36 to threadingly receive the screw 91, and with a radial slot 37 that extends through the upper wall 35 portion. The upper wall 35 and slot 37 are suitably sized so as to slidably receive the support boss 82 and the support struts 81, respectively, of the distribution skirt insert 12.

Also as shown, the inclined wall surface 33 of each of the air flow guides 32 of the throttle body 10 is provided with a vertical slot 38 to slidably receive an associated support strut 83. Preferably, each support strut 83 after being positioned in its associated slot 38 is then retained therein as by staking material of the internal wall surface 33 as at **33*a* into abutment against the upper edge surface of the associated support strut 83**.

As best seen in FIGS. 2 and 3, each distribution skirt 80 as thus mounted within an associated throttle bore of the throttle body 10 defines with the associated bore wall 25 two flow paths, one of which is external of the distribution skirt and the other being internally therethrough, with both flow paths being outwardly and downwardly inclined, that is, divergent in terms of the induction air flow through the throttle bore.

Each distribution skirt 80 thus provides a disruption to the high velocity radial air vectors that would otherwise occur as air enters the throttle bore if this distribution skirt is not used in the apparatus shown. By providing the distribution skirt 80, as shown, it allows the fuel spray cone discharged from an associate fuel injector 50 to flow down through the distribution skirt so as to pass thereunder and then enter the turbulent air stream at the lower edge of the distribution skirt. The fuel pattern below the distribution skirt will then be in the form of a finally atomized spray resulting in a more uniform air fuel distribution mixture flowing to the engine.

Referring again to the configuration of a distribution skirt 80, the cone angle defined, for example by the inner surface 86 thereof should be preselected relative to the fuel spray cone angle discharge from an associated fuel injector 50. For example, if the associated fuel injector 50 produces a fuel spray cone pattern having an included 70° angle, the angle of the distribution skirt 80 can then also be made at an angle of 70 degrees.

Preferably, as described hereinabove, each distribution skirt should be positioned at a predetermined distance below the spray tip end **50*a* of an associate fuel injector 50**. In this regard it should be noted that if the clearance between the top of the distribution skirt and the associate fuel injector is too small, large amounts of fuel can accumulate under the distribution skirt whereas if this clearance is too large it will result in excess air flow to the distribution skirt and a reduction in the fuel flow to the lower edge thereof.

In a particular throttle body injection apparatus application, the clearance between the bottom of a fuel injector 50 and its associate distribution skirt 80 was 2.0 mm. In this particular application, the angle of the distribution skirt matched the fuel spray cone angle of the fuel discharged in pulses from the fuel injector 50. In this same application, the major diameter of the distribution skirt was appropriately fixed so as to provide for fuel dispersion across at least 75 per cent of the throttle bore diameter at high engine speeds under wide open throttle operating conditions.

By the use of a subject distribution skirt 80 beneath an associate fuel injector 50, the following benefits are obtained: the direction of air flow through the distribution skirt 80 is such so as to substantially prevent collapse of the hollow conical spray pattern of the fuel as discharged from the associate fuel injector; the distribution skirt is operative to turn air flow vectors to pull the air-fuel mixture out to a larger diameter air flow stream; the distribution skirt is operative to desensitize the air-fuel mixture to upstream air cleaner, not shown, disturbances; and, it is operative to improve induction mixture distribution through air-fuel mixing disturbances.

While the invention has been described with reference to a particular embodiment disclosed herein, it is not confined to the details set forth since it is apparent that various modifications can be made by those skilled in the art without departing from the scope of the invention. For example, although in the embodiment described and illustrated the distribution skirts 80 are formed as part of a distribution skirt insert suitably fixed to the throttle body 10, it will be apparent that, if desired, each distribution skirt and its associated support struts could be formed integral with the throttle body 10. This application is therefore intended to cover such modifications or changes as may come within the purposes of the invention as defined by the following claims.

The embodiments of the invention in which an exclusive property or privilege is claimed are defined as follows:

1. A throttle body injection apparatus for a spark ignition, internal combustion engine comprising in combination: a throttle body having opposed inlet and outlet surfaces and at least one longitudinal cylindrical internal stepped wall defining a throttle bore extending from said inlet surface to said outlet surface and being adapted for communication at its inlet end with atmospheric air and at its outlet end with the intake manifold of the engine; a throttle valve of circular disc configuration pivotally positioned in said throttle bore intermediate said ends; an injector mechanism operatively connected to said throttle body, said injector mechanism including at least one fuel injector disposed above said inlet end and co-axial with said throttle bore, said fuel injector being adapted to receive low pressure fuel and to inject the same in pulses having a substantially hollow cone spray pattern; and, a distribution skirt of truncated, conical ring-like configuration operatively connected to said throttle body and positioned so that its convergent end is located next adjacent to and concentric with the discharge end of said fuel injector and so that its divergent end extends into said throttle bore upstream of said throttle valve, said distribution skirt thus being operative so as to divide the flow of atmospheric air into said throttle bore between a first flow path about the exterior of said distribution skirt and a second flow path through the interior of said distribution skirt whereby to effect improved air-fuel distribution in the charge being inducted into the engine.

2. A throttle body injection apparatus for a spark ignition, internal combustion engine comprising in combination: a throttle body having opposed inlet and outlet surfaces and at least one longitudinal cylindrical internal stepped wall defining a throttle bore extending from said inlet surface to said outlet surface and being adapted for communication at its inlet end with atmospheric air and at its outlet end with the intake manifold of the engine; a throttle valve of circular disc configuration pivotally positioned in said throttle bore intermediate said ends; and injector mechanism operatively connected to said throttle body, said injector mechanism including at least one fuel injector disposed above said inlet end and co-axial with said throttle bore, said fuel injector being adapted to receive low pressure fuel and to inject the same in pulses having a substantially hollow cone spray pattern of a predetermined included spray angle; and, a distribution skirt of truncated, conical ring-like configuration operatively connected to said throttle body the cone angle of said distribution skirt being substantially the same as said spray angle, said distribution skirt being positioned so that its convergent end is located next adjacent to and concentric with the discharge end of said fuel injector with its divergent end extending into said throttle bore upstream of said throttle valve, said distribution skirt thus being operative so as to divide the flow of atmospheric air into said throttle bore between a first flow path about the exterior of said distribution skirt and a second flow path through the interior of said distribution skirt.

3. A throttle body injection apparatus for a spark ignition, internal combustion engine comprising in combination: a throttle body having opposed inlet and outlet surfaces and at least one longitudinal cylindrical internal wall means defining a throttle bore extending from said inlet surface to said outlet surface, said throttle bore having an enlarged diameter inlet end for communication with atmospheric air and a reduced diameter outlet end for communication with the intake manifold of the engine; a throttle valve pivotally positioned in said outlet end of said throttle bore intermediate said ends to control flow therethrough; an injector mechanism including at least one fuel injector disposed above said inlet end with said fuel injector co-axial with said throttle bore, said fuel injector being adapted to receive low pressure fuel and to inject the same in pulses having a substantially hollow cone spray pattern; and at least one distribution skirt of truncated, conical ring-like configuration operatively associated with said throttle body and positioned so that its convergent end is located spaced a predetermined distance below the discharge end of said fuel injector with its divergent end extending into said inlet end of said throttle bore and upstream of said throttle valve, said distribution skirt thus being operative so as to divide the flow of atmospheric air through said inlet end of said throttle bore between a first flow path about the exterior of said distribution skirt and a second flow path through the interior of said distribution skirt.

* * * * *